US009179727B2

(12) United States Patent
Grant et al.

(10) Patent No.: US 9,179,727 B2
(45) Date of Patent: Nov. 10, 2015

(54) ENERGY DISSIPATION SYSTEM FOR A HELMET

(71) Applicants: Alan H. Grant, Chevy Chase, MD (US); Andrew K. Knutsen, Washington, DC (US)

(72) Inventors: Alan H. Grant, Chevy Chase, MD (US); Andrew K. Knutsen, Washington, DC (US)

( * ) Notice: Subject to any disclaimer, the term of this patent is extended or adjusted under 35 U.S.C. 154(b) by 84 days.

(21) Appl. No.: 13/965,564

(22) Filed: Aug. 13, 2013

(65) Prior Publication Data

US 2015/0047109 A1 Feb. 19, 2015

(51) Int. Cl.

| | |
|---|---|
| ***A42B 3/00*** | (2006.01) |
| ***A42B 3/06*** | (2006.01) |
| ***A42B 3/12*** | (2006.01) |

(52) U.S. Cl.

CPC ..... *A42B 3/064* (2013.01); *A42B 3/125* (2013.01); *A42B 3/06* (2013.01)

(58) Field of Classification Search

CPC ..... A42B 3/064; A42B 3/12; A42B 3/128; A42B 3/125

USPC ..... 2/414

See application file for complete search history.

(56) References Cited

U.S. PATENT DOCUMENTS

| | | | | |
|---|---|---|---|---|
| 1,251,537 | A | 1/1918 | Kempny | |
| 1,262,111 | A | 4/1918 | Slotoroff | |
| 1,280,322 | A | 10/1918 | Soren | |
| 2,197,174 | A | 4/1940 | Crosby | |
| 2,306,362 | A | 12/1942 | Wolff | |
| 3,153,242 | A * | 10/1964 | Nedwick | 2/411 |
| 3,237,201 | A | 3/1966 | Morgan | |
| 4,012,794 | A | 3/1977 | Nomiyama | |
| 4,075,717 | A * | 2/1978 | Lemelson | 2/412 |
| 4,307,471 | A | 12/1981 | Lovell | |
| 5,068,922 | A | 12/1991 | Zahn | |
| 5,204,998 | A | 4/1993 | Liu | |
| 8,127,373 | B1 | 3/2012 | Fodemski | |
| 8,296,863 | B2 | 10/2012 | Cripton et al. | |
| 2012/0233745 | A1 | 9/2012 | Veazie | |
| 2013/0061371 | A1 | 3/2013 | Phipps et al. | |
| 2014/0215694 | A1 * | 8/2014 | Grice | 2/411 |

* cited by examiner

*Primary Examiner* — Anna Kinsaul

(74) *Attorney, Agent, or Firm* — Studebaker & Brackett PC

(57) ABSTRACT

A helmet includes an inner and outer shell that are connected posterior of the head via a two degree freedom of movement rotating hinge. The connector allows for angular rotation about the inferior/superior and left/right axes. One potential mechanism for the connector is four springs, located left, right, inferior and superior of the connector, connected to both the inner and outer layers. The goal of the springs is two-fold to provide resistance in the event that the outer layer rotates with respect to the inner layer about either axis in response to an impact or applied force, and to rapidly return the outer layer to its equilibrium position post-impact or after the removal of the applied force.

14 Claims, 6 Drawing Sheets

ENERGY DISSIPATION SYSTEM FOR A HELMET

FIELD OF THE INVENTION

The present invention relates to the field of reducing an impact of force applied to a helmet protecting the head.

BACKGROUND OF THE INVENTION

From deep time, head impact collisions, have affected any and all types of human endeavor. However shock is produced from hitting an inanimate object; two or more individuals butting heads; and/or receiving contact from a moving external object. The result, in great frequency is: broken cranial bones; head/neck muscle strain; and/or brain tissue damage. Such head-impact collisions can, and do influence the post-impact future ability of the recipient to function adequately—in either a personal or societal world.

Of particular note, as the importance of preventing a debilitating injury from head trauma. This may occur in sports, such as cycling, football or other contact sports.

SUMMARY OF THE INVENTION

The goal of the helmet of the present invention is to reduce the acceleration experienced by the head in response to an impact/collision. While it is impossible to totally negate the consequences of an impact-collision, the present invention has evolved as a practical method of lessening these adverse consequences. It does so by several methods:

A. "Slipping the punch" of what would otherwise be a direct hit.

B. Thwarting some of the energy of impact away from the direction of impact.

The helmet consists of an inner and outer shell that are connected posterior of the head via a two degree freedom of movement rotating hinge. The connector allows for angular rotation about the inferior/superior and left/right axes. One potential mechanism for the connector is four springs, located left, right, inferior and superior of the connector, connected to both the inner and outer layers. The goal of the springs is two-fold—to provide resistance in the event that the outer layer rotates with respect to the inner layer about either axis in response to an impact or applied force, and to rapidly return the outer layer to its equilibrium position post-impact or after the removal of the applied force.

The inner and outer shells are formed of a hard plastic. The inner layer of the inner shell has padding on both its inner and outer surfaces. The padding on the inner surface acts to absorb energy and ensure that the helmet conforms tightly to the player's head (i.e., preventing "slip" between the helmet and the player's head). The padding on the outer surface of the inner shell is graduated in thickness from the posterior to anterior (thicker to thinner). The padding on the outer surface of the inner shell should be of lower stiffness compared to the padding on the inner surface of the inner shell. The goal of the padding on the outer surface of the inner shell is to further reduce impact in the event that the outer shell comes into contact with the inner shell.

The shape of the outer shell is similar to an egg—a larger radius of curvature on the posterior end and a smaller radius of curvature on the anterior end. The posterior end of the outer shell is fixed from translating with respect to the inner shell by the connector. The anterior end of the outer shell extends well past the inner shell and is shown in FIG. 1 extending beyond a leading edge of the inner shell. This increases the length of the moment arm about the connector.

For a given applied force/impact and strength of springs, the increase in the length of the moment arm will lead to an increase in the amount of rotation between the inner and outer layers. The maximal degree of rotation of the outer layer with respect to the inner layer is limited to be approximately 15 degrees by the maximum compression of the springs and direct contact of the inner and outer layers. A facemask should be attached to the anterior portion of the outer layer to allow the player to see and protect the face from impact.

These and other objects of the invention, as well as many of the intended advantages thereof, will become more readily apparent when reference is made to the following description taken in conjunction with the accompanying drawings.

BRIEF DESCRIPTION OF THE DRAWINGS

The following drawings illustrate examples of various components of the invention disclosed herein, and are for illustrative purposes only. Other embodiments that are substantially similar can use other components that have a different appearance.

DETAILED DESCRIPTION OF THE PREFERRED EMBODIMENTS

Figure 1:
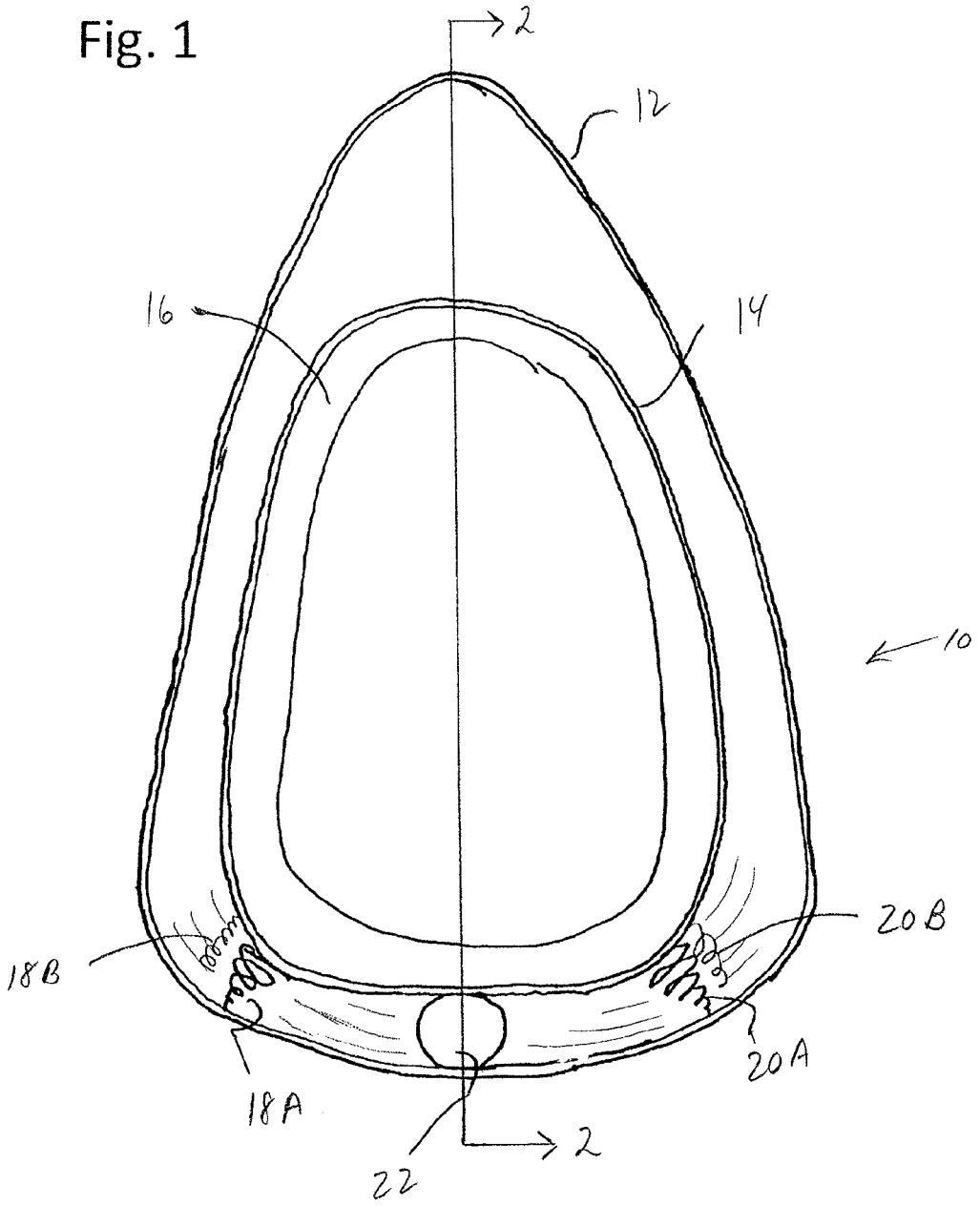
FIG. 1 is an axial drawing of a helmet embodying the teachings of the present invention.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 2:
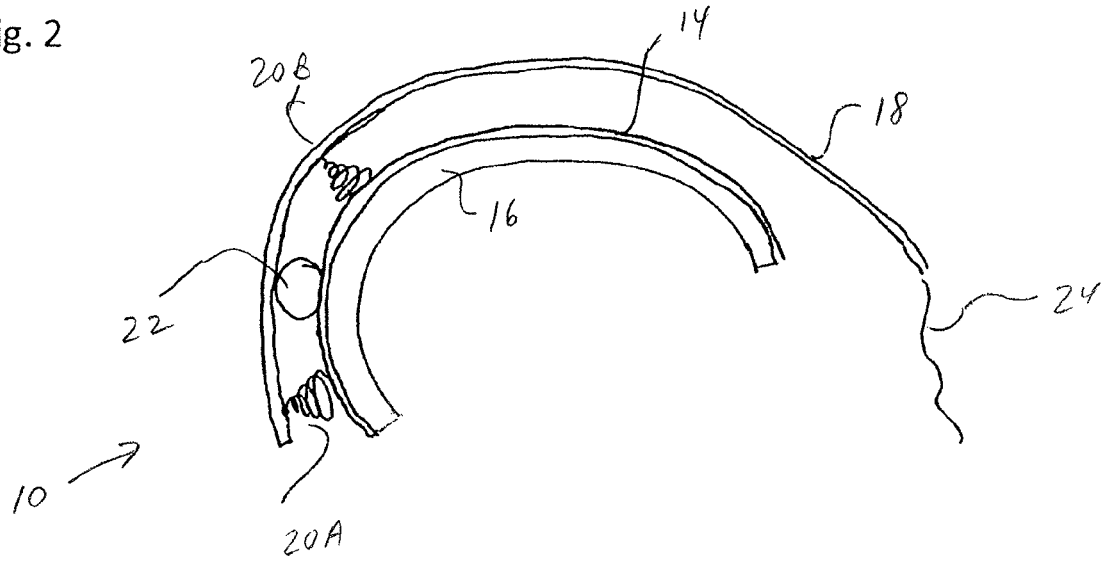
FIG. 2 is a sectional drawing of the helmet taken along line 2-2 of FIG. 1.
Figure 3:
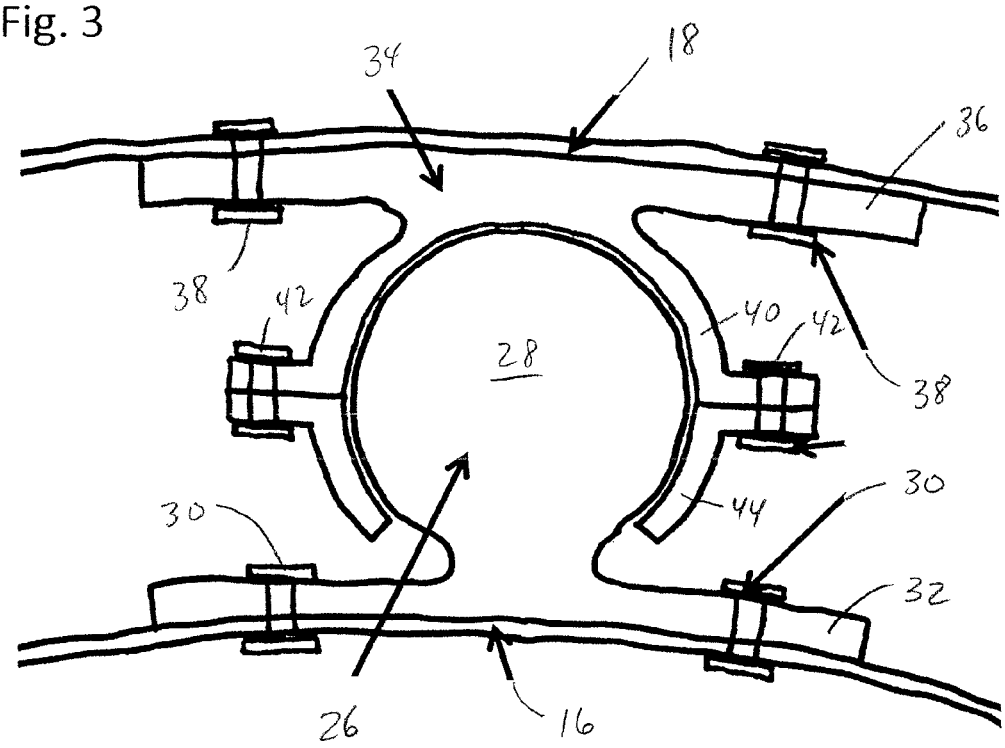
FIG. 3 is a detailed drawing of a pivot point connector between the inner and outer layers of the helmet.

With reference to the drawings, in general, and to FIGS. 1 through 3, in particular, an energy dissipation system embodying the teachings of the subject invention is generally designated as 10. With reference to its orientation in FIG. 1, the energy dissipation system includes a rigid outer shell 12 and a rigid inner shell 14. Included within an inner layer of the inner shell is padding material 16.

A series of springs or dampers interconnect the inner shell and the outer shell. As shown in FIG. 1, springs or dampers 18A, 18B are shown on one side of a space between the inner and outer shells and springs 20A, 20B are shown on the opposite side at a corresponding position in the space between the inner and outer shells. Also, interconnecting the inner and outer shells is a connector 22, such as a hinge or ball and socket connector. An optional face mask 24 is shown at the front end of the system 10 in FIG. 2.

With reference to FIG. 3, an example of a connector 26 located between the outer shell 18 and the inner shell 16 is shown. Connector 26 includes a spherical ball joint 28 secured by rivets or bolts 30 to the inner shell through a flat plate portion 32. Opposed to the spherical ball joint 28 is a capturing socket 34. Socket 34 surrounds the spherical ball joint 28 and is anchored by flat plate portion 36 riveted by rivets 38 to outer shell 18.

The flat plate portion terminates in a semi circular portion 40 which is connected by rivets 42 to a partial spherical extension portion 44 which encompasses a lower portion of the spherical ball joint 28. The lower portion of ball joint 28 is located below a plane dividing the ball joint 28 in half The amount of extension of portion 44 permits relative rotation between the inner and outer shells to an approximate fifteen degree amount of divergence.

Figure 5A:
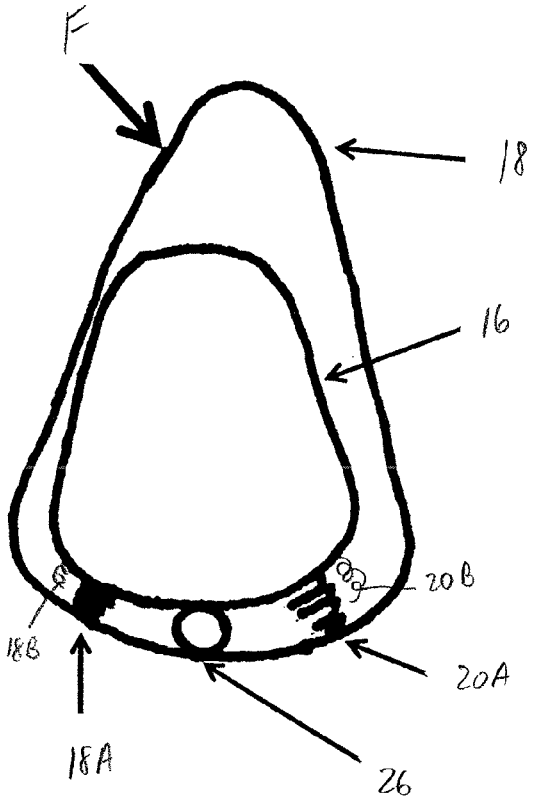
FIGS. 5A and 5B illustrate alternate maximum rotation in opposite side directions of an inner layer with respect to an outer layer

Therefore, as schematically shown in FIGS. 5 and 6, a force F applied in FIG. 5A to the outer shell 18 causes movement of the outer shell with respect to the inner shell 16 so as to compress springs 18A and 18B. The relative rotation of the outer shell with respect to the inner shell is pivoted about connector 26.

Figure 5B:
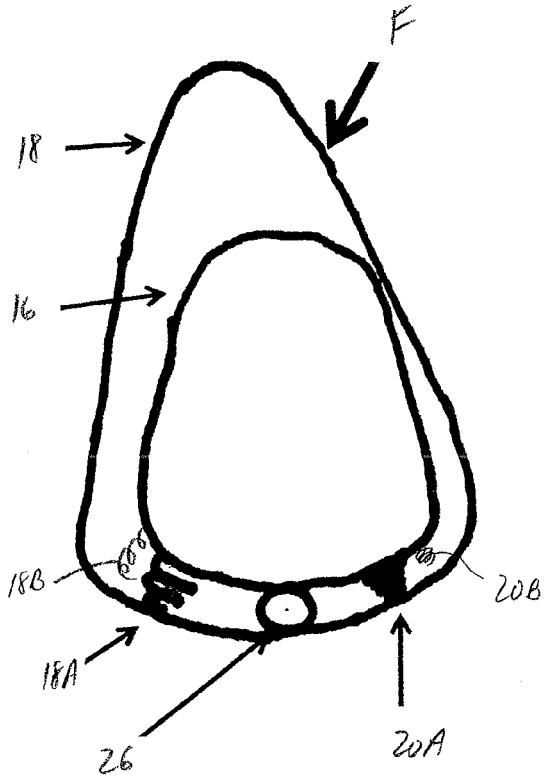

Similarly, in FIG. 5B, when force F is applied to the opposite side of the outer shell 18, the opposite movement of the outer shell 18 with respect to the inner shell is caused by compression of springs 20A, 20B and extension or stretching out of springs 18A, 18B by pivoting about the connector 26. After release of force F, the compressed springs tend to move the outer shell towards its original position as aided by the extended springs moving to their at rest position.

Figure 6A:
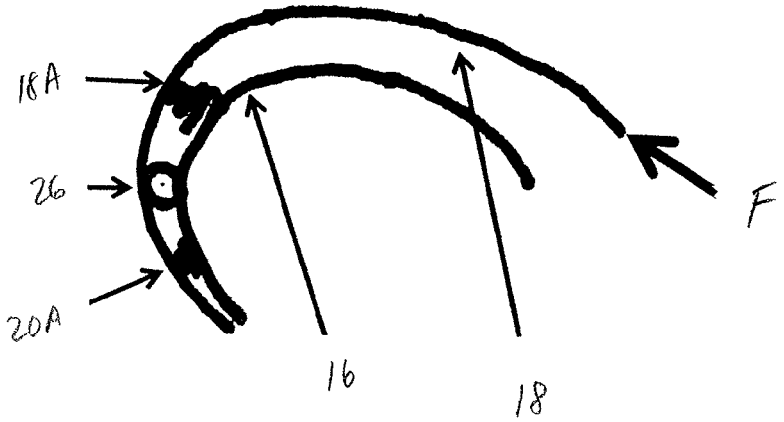
FIGS. 6A and 6B are sectional views illustrating the effects of rear and frontal impact forces, respectively.
Figure 6B:
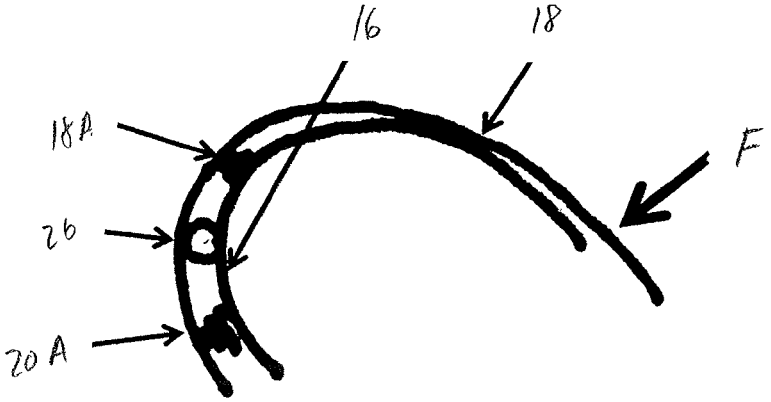

In FIGS. 6A and 6B, an upward force F is applied on the outer shell 18 to move the outer shell towards the inner shell 16 at the rear of the helmet. This compresses springs 20A, 20B and extends or stretches out springs 18A, 18B. The relative motion between the inner and outer shells is pivoted about connector 26.

When a force F is applied downward onto outer shell 18, as shown in FIG. 6B, the forward portion of the outer shell is moved closer to inner shell 16 such as to compress springs 18A, 18B and extend or stretch out springs 20A, 20B. The relative pivoting of the inner shell of the outer shell with respect to the inner shell is around connector 26.

Figure 4:
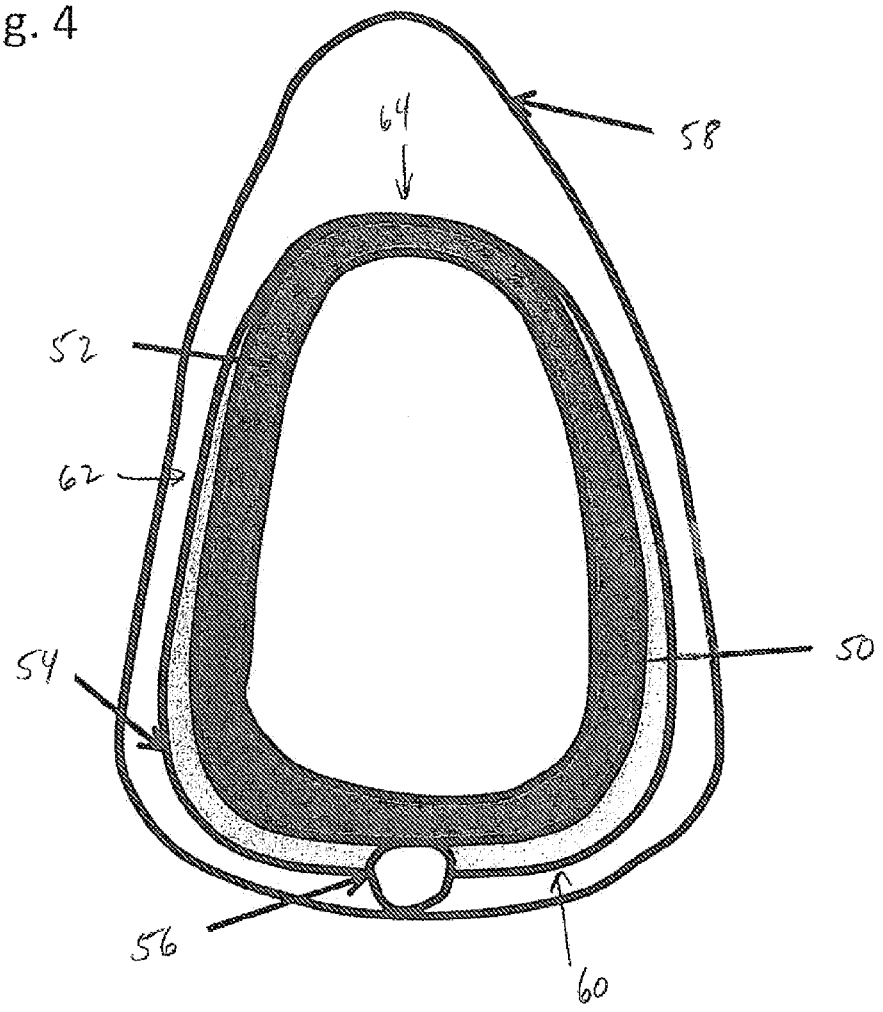
FIG. 4 is a sectional view illustrating an alternate arrangement of padding on the inner and outer surfaces of the inner shell.

In an alternate embodiment, as shown in FIG. 4, inner shell 50 includes inner padding layer 52 similar to the embodiment shown in FIG. 1. However, in this embodiment, an outer padding material layer 54 surrounds a majority of the exterior surface of inner shell 50. Connector 56 is similar to the connector 26 shown in FIG. 3 to interconnect the inner shell 50 and outer shell 58.

Additionally, in this embodiment, outer padding material layer 54 is thicker at the rear portion 60 of the padding layer 54 and tapers to a thinner thickness along the side edges 62 of the inner shell and terminates just short of the front portion 64 of the inner shell. FIG. 4 shows the outer padding layer 54 spaced from a leading edge of the outer shell. In this embodiment, springs as shown in FIG. 1 may be included between the inner and outer shell. However, the tapering of the outer padding layer 54 on the inner shell, serves to cushion the contact of the outer shell against the inner shell, depending upon the direction of force on the outer shell 58.

By the various embodiments of the present invention, an exterior force applied to an outer shell of a helmet is compensated for so as to slightly shift the direction of force to avoid a direct transfer to the inner shell in the direction of the exteriorly applied force. This slight shifting of transmission of force tends to lessen the impact of the force on the inner shell and increases the protection of the head contained in the inner shell of the helmet.

The foregoing description should be considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention.

We claim:

1. A helmet comprising:

an inner shell for containing the head of a wearer, an outer shell, said outer shell being pivotally and rotatably mounted on said inner shell, wherein a shape of said outer shell includes a larger radius of curvature on a posterior end compared to a smaller radius of curvature on an anterior end, a gap located between said inner shell and said outer shell, and a pivotal connector located in said gap, said pivotal connector being secured to said inner shell and to said outer shell, said pivotal connector including two connector pieces, one of said two pieces extending from one of said inner shell and said outer shell and the other of said two pieces extending from the other of said inner shell and said outer shell, the other piece being a spherical ball joint, the one piece capturing the other piece as a two degree of freedom of movement rotating hinge, the rotating hinge allowing a limited degree of shifting of said outer shell with respect to said inner shell when a force is applied to said outer shell.

2. The helmet according to claim 1, wherein said limited degree of shifting is approximately 15°.

3. The helmet according to claim 1, wherein a plurality of springs interconnect said inner shell and said outer shell in said gap for returning the outer shell to an original position with respect to the outer shell after the force is removed from the outer shell.

4. The helmet according to claim 3, wherein there are four springs in said gap.

5. The helmet according to claim 4, wherein two sets of two springs are vertically aligned in said gap.

6. The helmet according to claim 1, wherein said inner shell includes an interior padding layer and an exterior padding layer.

7. The helmet according to claim 5, wherein the two sets of springs are located on opposite sides of the pivotal connector.

8. The helmet according to claim 6, wherein said exterior padding layer is thickest at a rear portion of said inner shell.

9. The helmet according to claim 8, wherein said exterior padding layer tapers in thickness from said rear portion to a front portion of said inner shell.

10. The helmet according to claim 9, wherein said exterior padding layer terminates just short of said front portion of said inner shell, spaced from a leading edge of said outer shell.

11. The helmet according to claim 1, wherein the anterior end of the outer shell extends beyond a leading edge of the inner shell.

12. The helmet according to claim 1, wherein the one piece includes a semi-circular portion and a partial spherical extension portion.

13. The helmet according to claim 12, wherein the partial spherical extension portion limits relative movement of the other piece with respect to the one piece by engagement of the partial spherical extension portion with a mounting plate of the spherical ball joint.

14. The helmet according to claim 1, wherein the pivotal connector is located at a rear of the inner and outer shells.

* * * * *